United States Patent [19]

Nishiwaki

[11] Patent Number: 4,982,469

[45] Date of Patent: Jan. 8, 1991

[54] APPARATUS FOR CLEANING SURFACE OF SHEET

[75] Inventor: Hiroshi Nishiwaki, Izumi, Japan

[73] Assignees: Techno Roll Co., Ltd.; Kawasaki Steel Corp, Japan

[21] Appl. No.: 459,936

[22] Filed: Jan. 2, 1990

[30] Foreign Application Priority Data

Jan. 17, 1989 [JP] Japan ..... 1-9483

[51] Int. Cl.[5] ..... B08B 11/02

[52] U.S. Cl. ..... 15/3; 15/102; 15/104 A; 29/DIG. 7

[58] Field of Search ..... 15/3, 77, 100, 102, 15/104 A; 134/9; 29/DIG. 7

[56] References Cited

U.S. PATENT DOCUMENTS 3,837,952 9/1974 Mogford ..... 15/104 A X

*Primary Examiner*—Edward L. Roberts

*Attorney, Agent, or Firm*—Austin R. Miller

[57] ABSTRACT

A sheet surface cleaing apparatus for cleaning the surface of a sheet on which painting or printing is to be conducted. The apparatus has a rotatable dust removing roll having a sticky surface capable of making rolling contact with the sheet surface to be cleaned. The apparatus also has a roll cleaning device mounted for movement parallel with the axis of rotation of the dust removing roll and capable of cleaning the surface of the dust removing roll. The dust removing roll is mounted for swinging movement between a position where it engages the roll cleaning device and a position where it engages the sheet surface. The surface of the roll cleaning device contactable with the dust removing roll is formed of a flexible porous cleaning pad which is mounted so as to be delivered in a direction perpendicular to the axis of rotation of the dust removing roll.

5 Claims, 3 Drawing Sheets

APPARATUS FOR CLEANING SURFACE OF SHEET

BACKGROUND OF THE INVENTION

1. Field of the Invention

The present invention relates to an apparatus for cleaning the surface of a sheet. More particularly, the invention is concerned with an apparatus for removing dust or contaminant attached to the surface of a sheet such as a sheet of a metal, e g., iron, copper or aluminum, on which a paint, ink or the like is to be applied, or a sheet of paper, film and so forth which is to be used for a printing purpose.

2. Description of the Prior Art

When a paint or an ink is to be applied to a metallic sheet, plywood sheet or the like, if any dust or other contaminant remains on the sheet surface, such dust or contaminant will be strongly bonded to the sheet surface by the paint or ink unless it is suitably removed. Therefore, painting apparatus or printing apparatus usually employs a dust removing device such as a brush-roller type device or a vacuum-type device capable of removing the dust or contaminant immediately before the painting or printing.

These known dust removing devices such as the brush-roll type or vacuum-type cannot satisfactorily remove fine dust particles instantaneously. Fine dust particles remaining on the sheet surface undesirably form pin-holes or color spots so as to seriously impair the quality of the sheet product.

In order to obviate these problems, the present inventor has proposed, in Japanese Patent Unexamined Publication No. 63-12388, a cleaning apparatus having a roll with tackiness so that the sheet surface is cleaned as the roll is made to roll on the sheet surface.

This cleaning apparatus, however, requires that the painting or printing apparatus has to be temporarily stopped when the cleaning is to be conducted. In addition, the cleaning operation with the roll has to be executed manually.

Thus, there is a demand for apparatus which can automatically clean the sheet surface.

OBJECT OF THE INVENTION

Accordingly, an object of the present invention is to provide a sheet surface cleaning apparatus in which the cleaning roll proposed in the aforementioned patent publication can automatically clean a sheet surface without requiring the sheet to be stopped, thereby to improve the quality of the product while attaining a higher production efficiency.

The above and other objects, features and advantages of the present invention will become clear from the following description when the same is read in conjunction with the accompanying drawings.

BRIEF DESCRIPTION OF THE DRAWINGS

FIG. 2 is a perspective view of important portions of the sheet cleaning apparatus shown in FIG. 1, while

DESCRIPTION OF THE PREFERRED EMBODIMENTS

The invention will be fully described with reference to the accompanying drawings, which are not intended to limit the scope of the invention, which is defined in the claims.

Figure 1:
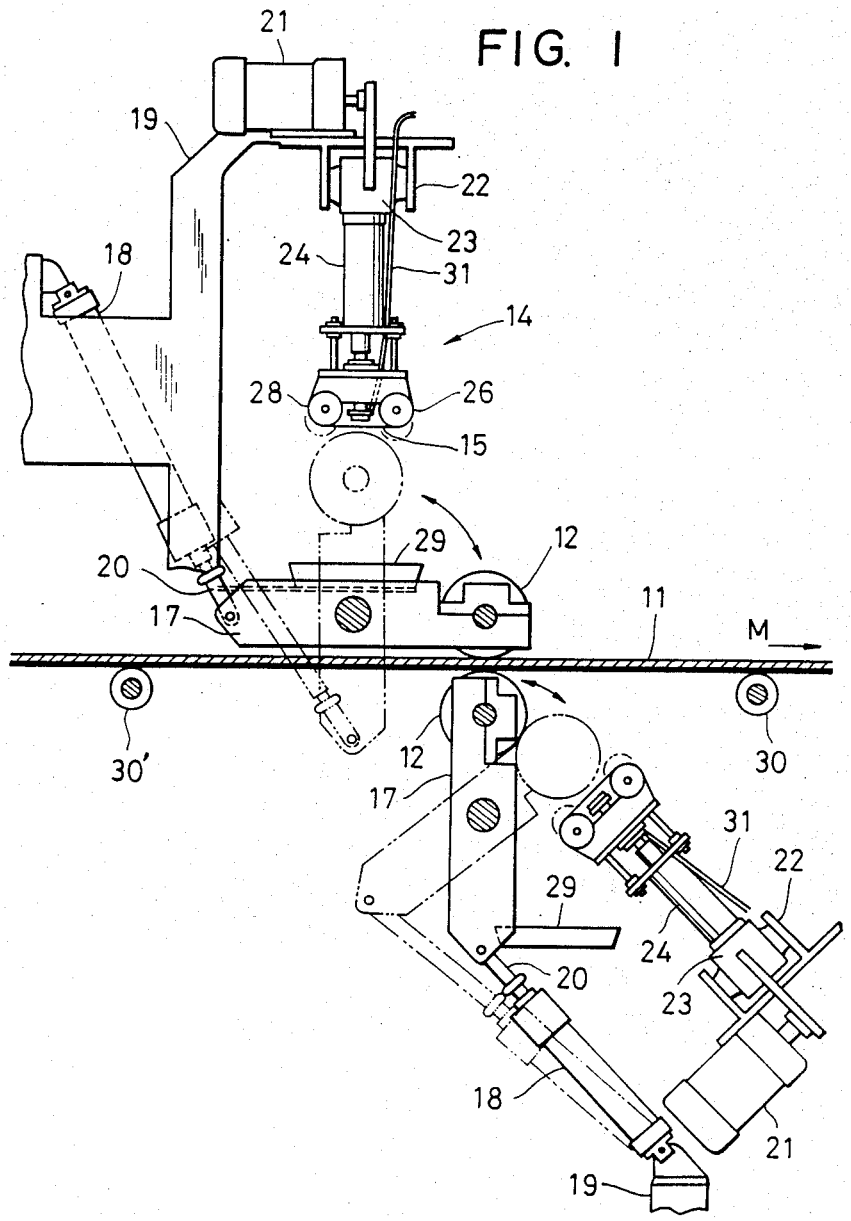
FIG. 1 is a sectional side elevational view of a critical portion of an embodiment of one form of sheet surface cleaning apparatus embodying features of the present invention.
Figure 2:
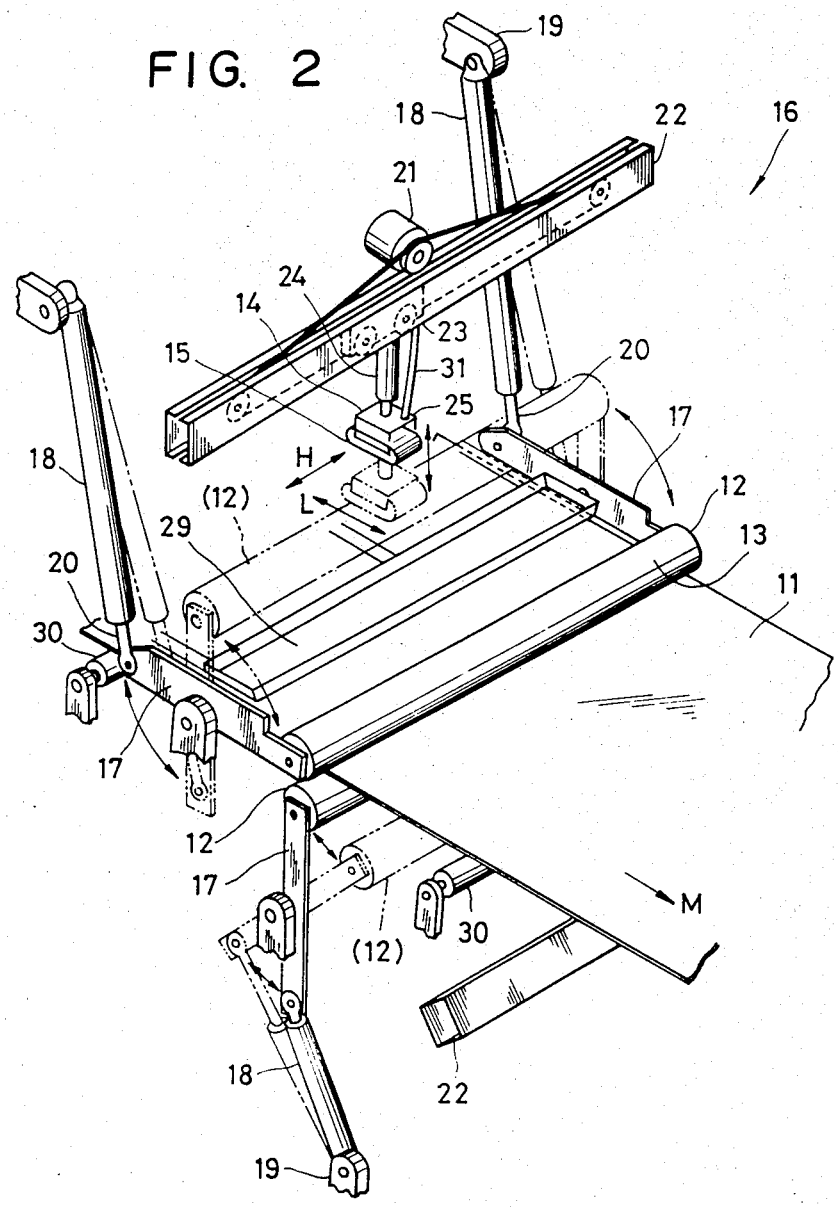

Referring to FIGS. 1 and 2, a pair of cleaning apparatus 16 are arranged on the obverse and reverse sides of a sheet 11 which is being fed. Each sheet cleaning apparatus 16 has a dust removing roll 12 rotatably supported on an end of a rocker arm 17 the rear end of which is connected to a frame 19 through a hydraulic cylinder 18.

The hydraulic cylinder 18 is capable of selectively extending a push rod 20 so as to cause the rocker arm 17 to rock, thereby to move the dust removing roll 12 towards a roll cleaning device 14.

The surface 13 of the dust removing roll is made of a polymeric material such as butyl rubber or a soft polyurethane which is made sticky by, for example, isoprene.

The roll cleaning device 14 is carried by a slider 23 through a hydraulic cylinder 24. The slider 23 is driven by a motor 21 so as to move along rails 22 in sliding contact therewith. A flexible porous cleaning pad 15 is carried by the surface of the roll cleaning device 14 facing the dust removing roll 12.

Figure 3:
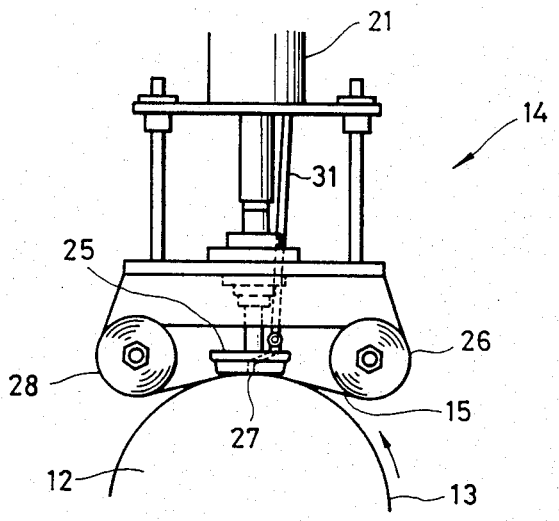
FIG. 3 is a side elevational view of a roll cleaning device.

The cleaning pad 15 is wound on a delivery roll 26 and is delivered as required so as to be taken-up by a take-up roll 28. The arrangement is such that the cleaning pad 15 is pressed onto the dust removing roll 12 by a push rod 25 when the latter is pushed by a hydraulic cylinder 24. Referring to FIG. 3, a nozzle 27, which is capable of supplying a cleaning liquid to the cleaning pad 15 through a liquid supply pipe 31, is connected to the roll cleaning device 14. A tank 29 for receiving cleaning liquid dripping from the roll cleaning device is disposed under the roll cleaning device 14. The tank 29 is supported by the frame 19 in the manner shown in FIG. 2 and has a breadth and a length which are large enough to prevent the cleaning liquid from being spilt and scattered on the surface of the sheet 11. A suitable solution containing an organic solvent which does not dissolve the resin film on the surface 13 of the roll or an aqueous solution of a detergent is used as the cleaning liquid.

The dust removing roll 12 is driven by a motor (not shown) uni-directionally through a one-way clutch or a ratchet wheel. When the motor is not operating, the dust removing roll 12 can freely rotate in the direction M of feed of the sheet.

The sheet 11 is continuously fed on guide rolls 30,30' towards a coating section such as used in a printing system.

The embodiment shown in FIGS. 1 and 2 has a pair of cleaning apparatus 16: namely, one on the obverse side and the other on the reverse side of the sheet 11. This, however, is only illustrative and one, two or more pairs of the cleaning apparatus 16 may be arranged along the path of feed of the sheet 11.

As a result, when at least one pair, out of two or more such pairs, of the cleaning apparatus 16 is in operation, it is possible to exchange the cleaning pad 15 of the cleaning roll 12 which is swung up away from the sheet 11, or to perform maintenance work on the cleaning apparatus 16 with no interruption of the cleaning operation.

In operation, each dust removing roll 12 is held in rolling contact with the sheet 11 so that dust and other contaminant attached to one or both surfaces of the sheet is adsorbed and removed by the dust removing roll 12.

Then, depending on the degree of contamination of the dust removing roll 12 by the adsorbed dust, the hydraulic cylinder 18 is operated to move the dust removing roll 12 toward the roll cleaning device 14. At the same time, the hydraulic cylinder 24 is operated so as to push the roll cleaning device 14 thereby bringing the cleaning pad 15 into pressure contact with the dust removing roll 12.

Subsequently, the roll cleaning device 14 is reciprocatingly driven in the direction of the axis H (FIG. 2) while the cleaning liquid is supplied from the cleaning liquid supply nozzle 27 to the cleaning pad 15. Simultaneously, the dust removing roll 12 is power driven to rotate so that the surface 13 of the dust removing roll 12 is cleaned by the cleaning pad 15.

The delivery roll 26 is allowed to rotate in accordance with the degree of contamination of the cleaning pad 15 so that the contaminated portion of the cleaning pad 15 is taken-up by the take-up roll 28.

The dust on the surface 11 of the sheet is automatically transferred to the cleaning pad 15 through the dust removing roll 12. It is possible to continuously clean the surfaces of the sheet 11 by providing a plurality of such dust removing rolls 12 along the path of feed of the sheet.

According to the invention, the cleaning pad 15 is moved in the direction H substantially parallel to the axis of rotation of the dust removing roll 12, so that the following advantages are obtained.

(1) The dust removing roll 12 is rubbed not only in the rotational direction but also in the axial direction H (transverse to the machine direction M), so that the roll 12 can be much more effectively cleaned.

(2) The width of the cleaning pad 15 may be made very small, e.g., only a fraction of the axial length of the cleaning roll 12.

(3) Since the cleaning pad 15 can be made with an effectively small area, it is possible with the use of reasonable force to press the cleaning pad 15 under high pressure onto the roll 12, so that dust particles can be satisfactorily removed even when they tend strongly to adhere to the surface of the dust removing roll 12.

(4) It is possible to easily renew the cleaning pad 15 simply by shifting it to one end of the dust removing roll 12.

(5) The cleaning pad 15 may be made so small that the roll cleaning device 14 can have a compact construction. Thus, the cleaning apparatus does not cause any hindrance to daily operation of the production system.

(6) Since the dust removing operation may be fully automated, it is possible to enhance the production efficiency of the sheet-handling production system.

Although this invention has been described with reference to a specific embodiment thereof, it will be appreciated that many variations may be made without departing from the spirit of the invention. For example, parts may be reversed, certain features may be used independently of other features, and equivalent elements may be substituted for those specifically shown and described, all without departing from the scope of the invention as defined in the appended claims.

What is claimed is:

1. A sheet surface cleaning apparatus comprising: a rotatable dust removing roll having a sticky surface, means causing said roll to make rolling contact with the sheet surface to be cleaned; and a roll cleaning device mounted for movement substantially parallel with the axis of rotation of said dust removing roll and capable of cleaning the surface of said dust removing roll; wherein said dust removing roll is mounted for swinging movement between a position where it engages said roll cleaning device and a position where it engages said sheet surface, and wherein the surface of said roll cleaning device contactable with said dust removing roll is formed of a flexible porous cleaning pad which is mounted so as to be delivered in a direction substantially perpendicular to the axis of rotation of said dust removing roll.

2. A sheet surface cleaning apparatus according to claim 1, wherein the surface of said dust removing roll is made of a polymeric material such as butyl rubber or soft polyurethane.

3. A sheet surface cleaning apparatus according to claim 1, further comprising a nozzle for supplying said cleaning pad with a cleaning liquid, and a tank disposed under said roll cleaning device and capable of receiving cleaning liquid dripping from said roll cleaning device.

4. A sheet surface cleaning apparatus according to claim 1, wherein at least two pairs of said cleaning apparatus are arranged along the path of feed of said sheet.

5. A sheet cleaning apparatus according to claim 1, further comprising means including a pad delivery roll for delivering said cleaning pad depending on the degree of contamination of said cleaning pad so as to take up a contaminated portion of said cleaning pad.

* * * * *